US006348909B1

(12) United States Patent
Kim

(10) Patent No.: US 6,348,909 B1
(45) Date of Patent: Feb. 19, 2002

(54) GREY-SCALE LCD DRIVER

(75) Inventor: Min-Seok Kim, Kyonggi-do (KR)

(73) Assignee: Samsung SDI Co., Ltd., Youngin (KR)

( * ) Notice: Subject to any disclaimer, the term of this patent is extended or adjusted under 35 U.S.C. 154(b) by 0 days.

(21) Appl. No.: 09/388,750

(22) Filed: Sep. 2, 1999

(30) Foreign Application Priority Data

Sep. 25, 1998 (KR) ..... 98-39995

(51) Int. Cl.[7] ..... G09G 3/36
(52) U.S. Cl. ..... 345/89
(58) Field of Search ..... 345/89, 87, 90, 345/92, 94, 98, 99, 50, 51, 52

(56) References Cited

U.S. PATENT DOCUMENTS 5,091,722 A * 2/1992 Kitajima et al. ..... 345/89
5,352,937 A * 10/1994 Dingwall ..... 327/65
5,659,331 A * 8/1997 Oh et al. ..... 345/95

FOREIGN PATENT DOCUMENTS

JP 2000105365 * 4/2000

* cited by examiner

*Primary Examiner*—Richard Hjerpe
*Assistant Examiner*—Ronald Laneau
(74) *Attorney, Agent, or Firm*—Robert E. Bushnell, Esq.

(57) ABSTRACT

The present invention provides a grey-scale LCD driver which can realize multi-gradation by varying a voltage applied to a liquid crystal layer. The grey-scale LCD driver includes a data storing section for storing n bits of digital data assigned for producing a grey scale; a counter for generating counting data; a comparator for comparing the digital data stored in the data storing section with the counting data outputted from the counter and outputting a comparing signal if the digital data is equal to the counting data to control a sampling switching means; a rectangular-waveform voltage generating means for generating a rectangular-waveform voltage signal applied to the sampling switching means as a driving voltage; an integrating circuit for shaping a rectangular-waveform voltage supplied through the switching means into a ramp voltage, the integrating circuit being composed of a liquid crystal capacitor and a resistor; and a discharging switch means for discharging charges accumulated in the liquid crystal capacitor according to a control signal of a controller.

12 Claims, 5 Drawing Sheets

GREY-SCALE LCD DRIVER

BACKGROUND OF THE INVENTION

1. Field of the Invention

The present invention relates to a grey-scale LCD driver which is able to realize multi-gradation of a liquid crystal display device by varying a voltage applied to a liquid crystal, and more particularly, to a grey-scale LCD driver which is able to realize multi-gradation by shaping a rectangular-waveform voltage used for a driving voltage into a ramp voltage through an integrating circuit and sampling the ramp voltage at selected bit timings.

2. Description of the Prior Art

Generally, liquid crystal display (LCD) devices are display units which display images by controlling the amount of light transmission utilizing dielectric anisotropy of liquid crystals, and are widely used as display units of laptop personal computer, word processor, and portable television receiver.

In the structure of the LCD device, there are a simple-matrix structure which controls arrangement of liquid crystal materials sandwiched between two stripe electrodes with a voltage generated at intersections of the stripe electrodes formed in a matrix shape, and an active-matrix structure which improves contrast, drive duty, and multi-gradation by adding thin film transistors to the simple matrix LCD device as a switching means for driving.

As shown in FIG. 4, a thin film transistor (TFT) active-matrix LCD device comprises an upper substrate 31, a lower substrate 51, and a liquid crystal layer 72 sandwiched between the upper substrate 31 and the lower substrate 51.

The upper substrate 31 comprises a polarizer 36 attached on an upper surface thereof, a color filter 34 sequentially disposed on a lower surface thereof, and a common electrode 32 disposed on the color filter 34. The common electrode 32 is made of Indium Tin Oxide (ITO).

The lower substrate 51 comprises thin film transistors TFT, an insulating layer 54, and pixel electrodes 52 electrically connected to the thin film transistors TFT through contact holes. Aligning films 75*a* and 75*b* rubbed in a predetermined direction are disposed on the common electrode 32 and the pixel electrodes 52, respectively. Therefore, the liquid crystal molecules of the liquid crystal layer 72 are twisted according to the rubbing direction of the aligning films 75*a* and 75*b*.

In the TFT active-matrix LCD device having above-mentioned structure, the thin film transistors TFT are turned on by signals applied to gate electrodes of the thin film transistors TFT, which results in that electrical signals applied to drain electrodes are applied to the pixel electrodes 52 through source electrodes. And then, the liquid crystal molecules sandwiched between the pixel electrodes 52 and the common electrode 32 are twisted in a direction different from a polarizing direction, which results in that the pixels are displayed.

In the LCD device, recently, the research and development to realize full-color closed to a natural color have been conducted. For example, Korean Patent Publication No. 96-3961 discloses three methods for realizing multi-gradation.

These three methods are a voltage-level driving method which displays multi-gradation by applying different levels of voltages, a frame driving method which displays multi-gradation by changing a effective voltage by varying a time for applying voltages in an unit frame, and a complex method which is in combination of the voltage-level driving method and the frame driving method.

These various methods are based on digital data from a controller, and the digital data is converted to analog data, which controls the voltage applied to the liquid crystal and time for applying the voltages to the liquid crystal layer. This leads the LCD device to realize multi-gradation of a unit pixel.

Hereinafter, a conventional grey-scale LCD driver for realizing multi-gradation will be explained in detail with reference to FIG. 5.

Referring to FIG. 5, the thin film transistor TFT of TFT LCD device is turned on by scan signals Vg applied to the gate electrode and transmits electrical signals applied from a switching element Q1 of the grey-scale LCD driver to the source electrode through the drain electrode. At this time, since the source electrode of the thin film transistor TFT is electrically connected to the pixel electrodes 52 on the lower substrate 51 shown in FIG. 4, a liquid crystal capacitor is formed between the pixel electrodes 52 of the lower substrate 51 and the common electrode 32 of the upper substrate 31.

Further, maintaining capacitor (not shown) connected in parallel with the liquid crystal capacitor is formed separately on the upper and lower substrate, in order to remove residual images by compensating DC voltage level shift which degrades the display quality at still images.

The conventional grey-scale LCD driver comprises a data storing section for storing n bits of digital data $A_0$~$A_{n-1}$ assigned for producing a grey-scale in synchronization with a clock signal CLK of a shift register, a counter 20 for generating counting data $B_0$~$B_{n-1}$ in synchronization with the clock signal CLK, a comparator 30 for comparing the digital data $A_0$~$A_{n-1}$ stored in the data storing section 10 with the counting data $B_0$~$B_{n-1}$ supplied from the counter 20 and outputting a comparing signal Comp if the digital data $A_0$~$A_{n-1}$ are equal to the counting data $B_0$~$B_{n-1}$ , a ramp voltage generating section 50 for generating a ramp voltage, a transistor Q1 for supplying the ramp voltage to the drain electrode of the thin film transistor TFT connected to the liquid crystal capacitor C depending on a signal from a sampling control section 40, and a sampling control section 40 for controlling the transistor Q1 in accordance with a control signal supplied from a controller (not shown) in order to sample the ramp voltage. Where, the transistor Q1 serves as a switching element.

The counter 20 divides selected time of a line into the number more than the number of gradations and counts them.

Now, the operation of the above-mentioned conventional grey-scale LCD driver will be explained.

The comparing signal Comp supplied from the comparator 30 is at inactive status, that is, a low level during the digital data $A_0$~$A_{n-1}$ stored in the data storing section 10 are not equal to the counting data $B_0$~$B_{n-1}$ supplied from the counter 20, and then if the digital data $A_0$~$A_{n-1}$ are equal to the counting data $B_0$~$B_{n-1}$ supplied from the counter 20, the comparing signal becomes a high level and activates the sampling control section 40. At this time, the sampling control section 40 outputs the sampling signal at a bit timing by means of the control signal Crt Sig supplied from the controller (not shown) and turns on the transistor Q1.

Therefore, the ramp voltage outputted from the ramp voltage generating section 50 passes through the transistor Q1 and the thin film transistor TFT and is charged in the liquid crystal capacitor C. And then, if the comparing signal Comp becomes the low level, the transistor Q1 is turned off. Therefore, the operation for charging the liquid crystal capacitor C is stopped.

The sampling bit timing is determined in accordance with the digital input data $A_0 \sim A_{n-1}$ , and the liquid crystal capacitor C is charged to the voltage having a selected level within levels of multi-gradation, and then the selected level of multi-gradation is displayed.

Namely, the voltage for displaying a desired level of gradation is determined in accordance with the bit timing to be sampled, that is, position of a slope of the surface of the waveform of the ramp voltage to be sampled.

The number of bits of the counter 20 determines the number of gradations, which are realized by means of the LCD device. For example, if the number of bits is 8, it is possible that 256 gradations are realized ($2^8$=256).

Conclusively, in order to display the number of gradation, the conventional grey-scale LCD driver controls time for charging the liquid crystal capacitor C in accordance with the value of the digital data $A_0 \sim A_{n-1}$ . The charging voltage of the liquid crystal capacitor C is determined according to the ramp voltage that is varied according to the elapsed time and the charging time.

However, as mentioned above, since the conventional grey-scale LCD driver uses the ramp voltage as the driving voltage for multi-gradation, an output impedance of the ramp voltage generation section 50 is easily changed according to the sampled position of the ramp voltage, and a noise voltage is generated.

At this time, if the noise voltage is greater than the voltage sampled at a least significant bit of the digital bit $A_0 \sim A_{n-1}$ , the gradation corresponding to the least significant bit is not displayed. Therefore, the lower bit having voltage less than the noise voltage is not displayed, and it is impossible to display a large number of gradations.

Further, during the fabrication of the LCD device, since the ramp voltage generating section 50 is connected to a plurality of column of the transistor Q1 of the grey-scale LCD driver, and the magnitude of the load is changed by the number of the transistor Q1, it is required that the design of the ramp voltage generating section 50 is adjusted when it is applied to the LCD having different resolutions.

Since the ramp voltage generating section 50 used in the conventional grey-scale LCD driver is sensitive to load changes, the conventional grey-scale LCD driver lacks in the compatibility with respect to the change of the resolution of the LCD device.

Further, the ramp voltage generating section 50 is fabricated by a precise complicate driving circuit. By this, if the ramp voltage generation section 50 is used, the fabricating cost of the products is increased, and when the ramp voltage generating section 50 is mounted on a liquid crystal display panel, the area occupied by the ramp voltage generating section 50 is increased.

SUMMARY OF THE INVENTION

The present invention has been made in an effort to solve the above-described problems.

Therefore, it is an object of the present invention to provide a grey-scale LCD driver which can reduce the production cost of a liquid crystal display(LCD) device as well as the area which is occupied by a ramp voltage generating section on a LCD panel by using a rectangular-waveform signal as a driving signal instead of a conventional ramp voltage generating section, and transforming the rectangular-waveform voltage into a ramp voltage by a simple circuit.

It is another object of the present invention to increase the number of bits to be sampled or solve conventional problem which is not able to accurately sample the number of bits as many as a specified number by reducing a noise generated upon sampling the least significant bit Further object of the present invention is to provide a grey-scale LCD driver, which responds to load changes so that the converter can be compatible with LCD devices having the different resolutions by using a circuit for generating the rectangular-waveform voltage to accurately display the least significant bit even when the number of bits to be displayed is increased.

To achieve the above objects, the present invention provides a grey-scale LCD driver comprising a data storing section for storing n bits of digital data assigned for producing a grey-scale in synchronization with a clock signal of a shift register; a counter for generating counting data in synchronization with the clock signal; a comparator for comparing the digital data stored in the data storing section with the counting data outputted from the counter and outputting a comparing signal if the digital data is equal to the counting data to control a sampling switching means; a rectaiagular-waveform voltage generating means for generating a rectangular-waveform voltage signal applied to the sampling switching means as a driving voltage; an integrating circuit for shaping a rectangular-waveform voltage supplied through the switching means into a ramp voltage, the integrating circuit being composed of a liquid crystal capacitor and a resistor; and a discharging switch means for discharging charges accumulated in the liquid crystal capacitor according to a control signal of a controller.

The driving voltage is applied to a thin film transistor being turn on or off in accordance with the control signal of the controller.

The resistor according to the present invention may be between the thin film transistor and the liquid crystal capacitor, or between the thin film transistor and the sampling switching means.

Further, the discharging switch means comprises a thin film transistor, and is between the resistor and the liquid crystal capacitor.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF PREFERRED EMBODIMENT

Reference will now be made in detail to the present preferred embodiment of the invention, an example of which is illustrated in the accompanying drawings. Wherever possible, the same reference numbers will be used throughout the drawings to refer the same or like parts.

Figure 1:
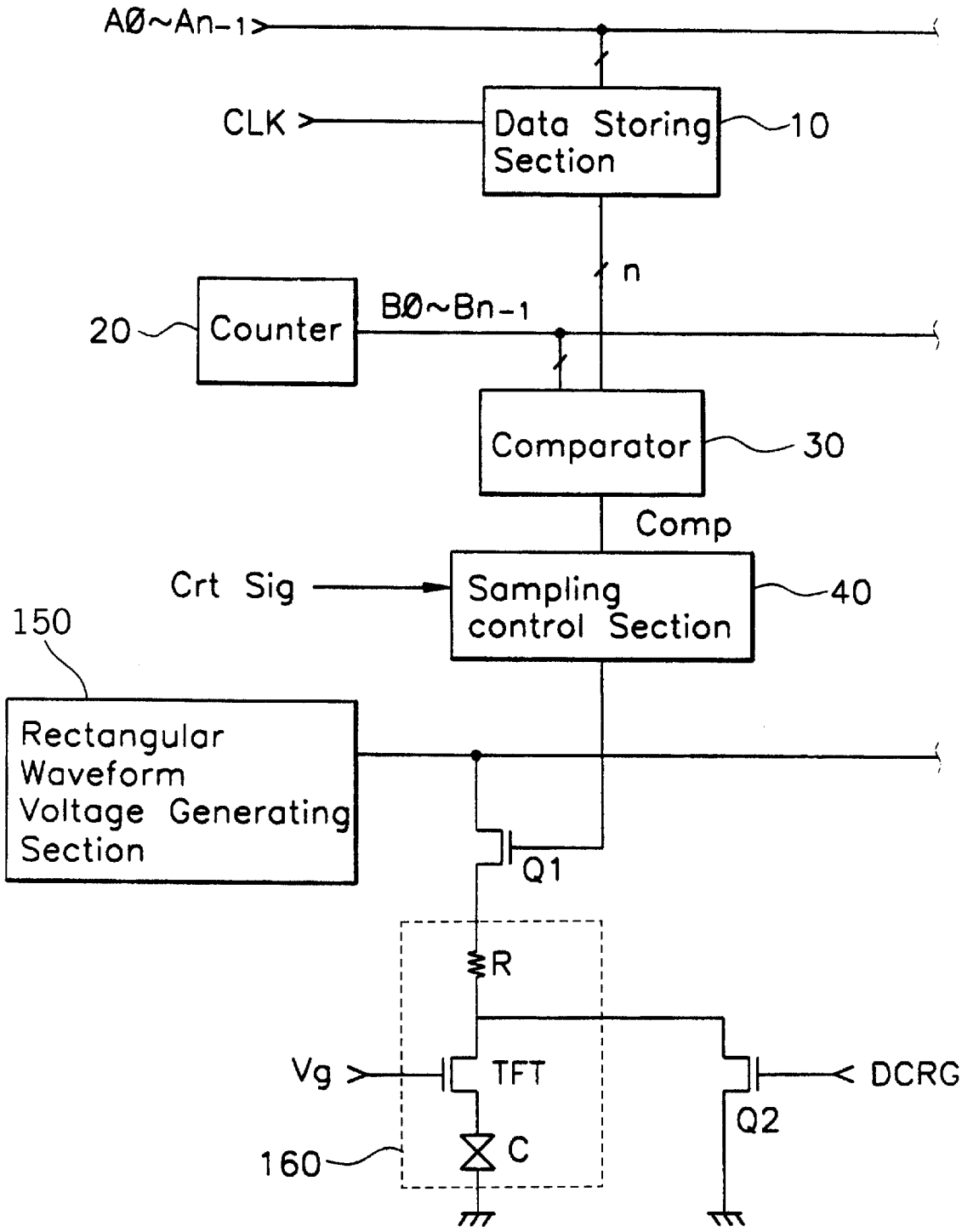
FIG. 1 is a circuit diagram of a grey-scale LCD driver according to a preferred embodiment of the present invention.

FIG. 1 is a circuit diagram of a grey-scale LCD driver according to the present invention.

The grey-scale LCD driver according to the present invention comprises a data storing section 10 for storing n bits of digital data $A_0$~$A_{n-1}$ assigned for producing a grey-level in synchronization with a clock signal CLK of a shift register, a counter 20 for generating counting data $B_0$~$B_{n-1}$ in synchronization with the clock signal CLK, a comparator 30 for comparing the digital data $A_0$~$A_{n-1}$ stored in the data storing section 10 with the counting data $B_0$~$B_{n-1}$ supplied from the counter 20 and outputting a comparing signal Comp if the digital data $A_0$~$A_{n-1}$ are equal to the counting data $B_0$~$B_{n-1}$ , and a sampling control section 40 for controlling a transistor Q1 which applies a driving voltage to a liquid crystal capacitor C in synchronization with a control signal Crt Sig of a controller (not shown).

Namely, a bit timing for grey-level is determined by comparing the digital data $A_0$~$A_{n-1}$ with the counting data $B_0$~$B_{n-1}$ of the counter 20 by the comparator 30, and the voltage applied to the liquid crystal capacitor C is controlled by turning on the transistor Q1 connected to the liquid crystal capacitor C in accordance with the control signal Crt Sig of the controller synchronized at the bit timing and sampling the driving voltage applied to the liquid crystal capacitor C, which results in a grey level display.

The grey-scale LCD driver according to the present invention is characterized in that it further comprises a rectangular-waveform voltage generating section 150 for generating a rectangular-waveform voltage as the driving voltage which is applied to the transistor Q1 an integrating circuit 160 for shaping the rectangular-waveform-m voltage into the ramp voltage, and a discharging switch Q2 for discharging the charges charged in the liquid crystal capacitor C in response to the control signal of the controller. An integrating circuit 160 is composed of the liquid crystal capacitor C, and a resistor R inserted between the transistor Q1 and the liquid crystal capacitor C.

In the grey-scale LCD driver according to the present invention, a thin film transistor TFT may be connected between the liquid crystal capacitor C and the transistor Q1, or the thin film transistor TFT may be omitted. That is, the present invention is not limited to an active-matrix LCD device.

Figure 2:
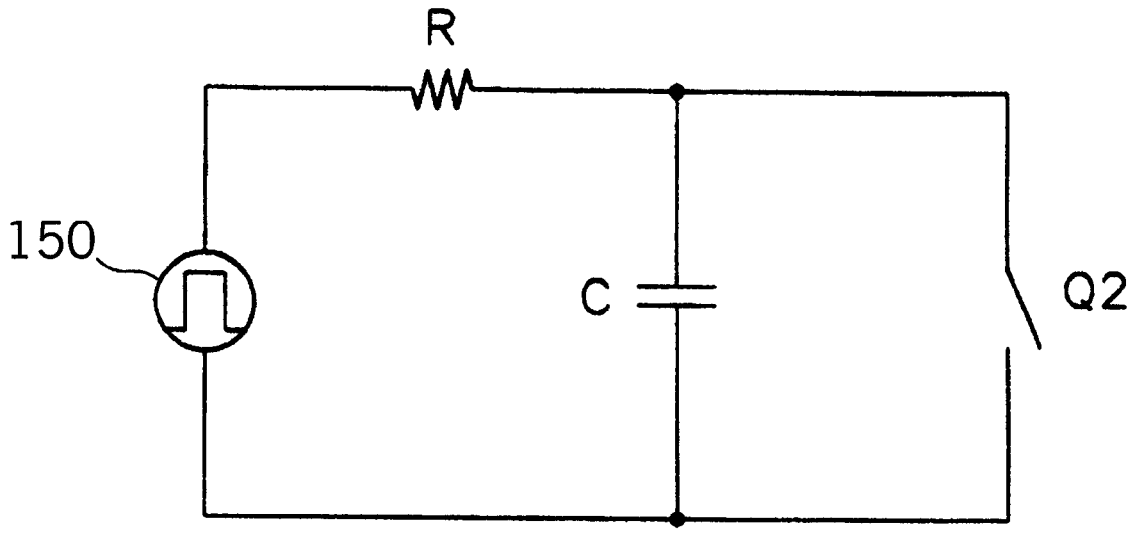
FIG. 2 illustrates an equivalent circuit of an integrating circuit shown in FIG. 1.

As shown in FIG. 2, since the integrating circuit 160 is an RC circuit having the liquid crystal capacitor C and the resistor R, even if the rectangular waveform voltage is applied as the driving voltage, the rectangular-waveform voltage of the liquid crystal capacitor C is gradually increased while charges are accumulated in the liquid crystal capacitor C, and then gradually discharged. As a result, by using the integrating circuit, the rectangular-waveform voltage is transformed into a waveform similar to a ramp voltage generated by a conventional ramp voltage generating section.

As mentioned above, the ramp voltage can be generated by inserting the resistor R between the thin film transistor TFT and the liquid crystal capacitor C without the ramp voltage generating section whose structure is complicated.

The slope of the ramp voltage waveform can be controlled by adjusting the value of the resistor R.

The resistor R may be inserted between the thin film transistor TFT and the liquid crystal capacitor C or between the thin film transistor TFT and the switching element Q1.

Figure 3:
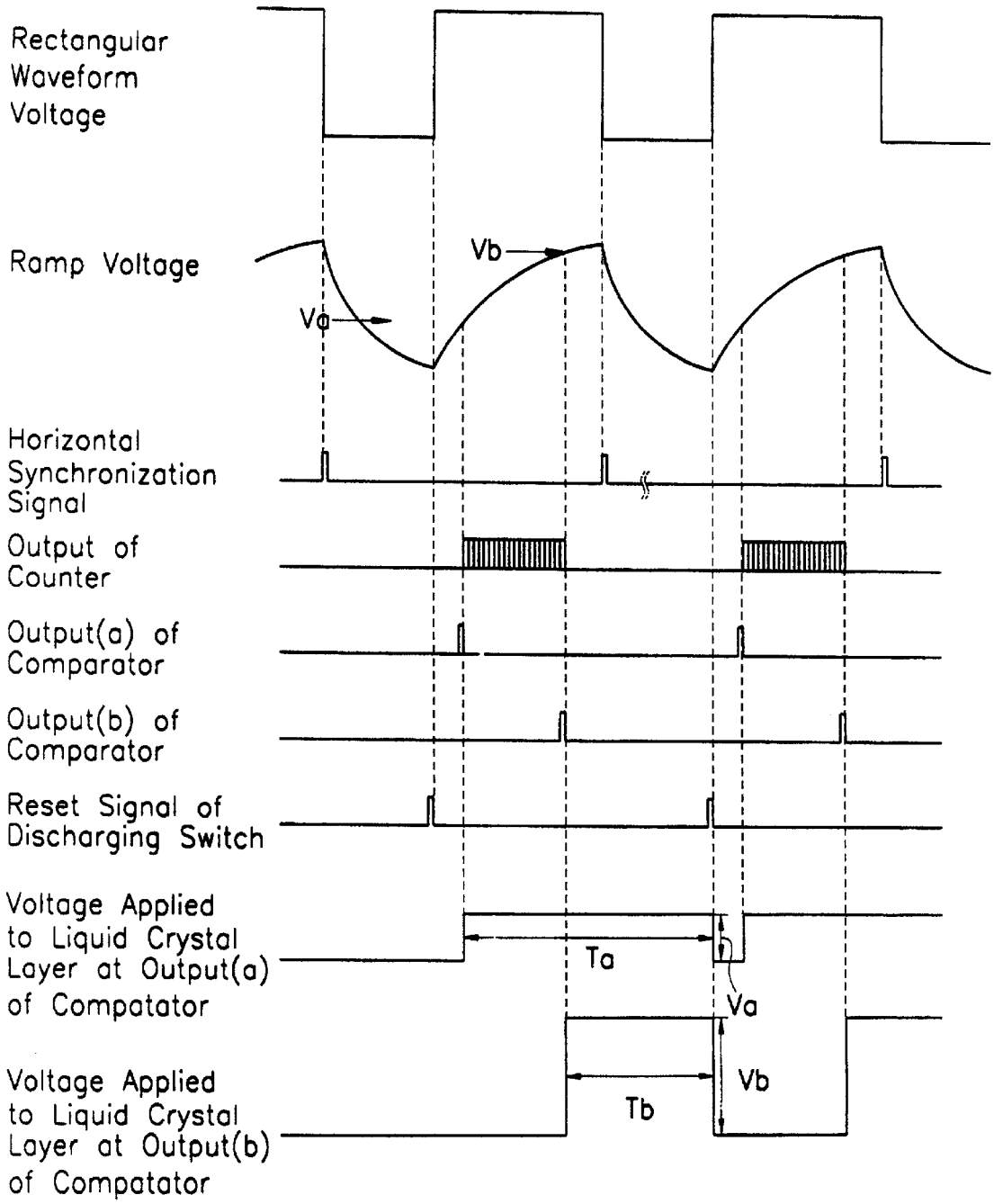
FIG. 3 is a pulse waveform diagram applied to a liquid crystal capacitor according to the present invention.
Figure 4:
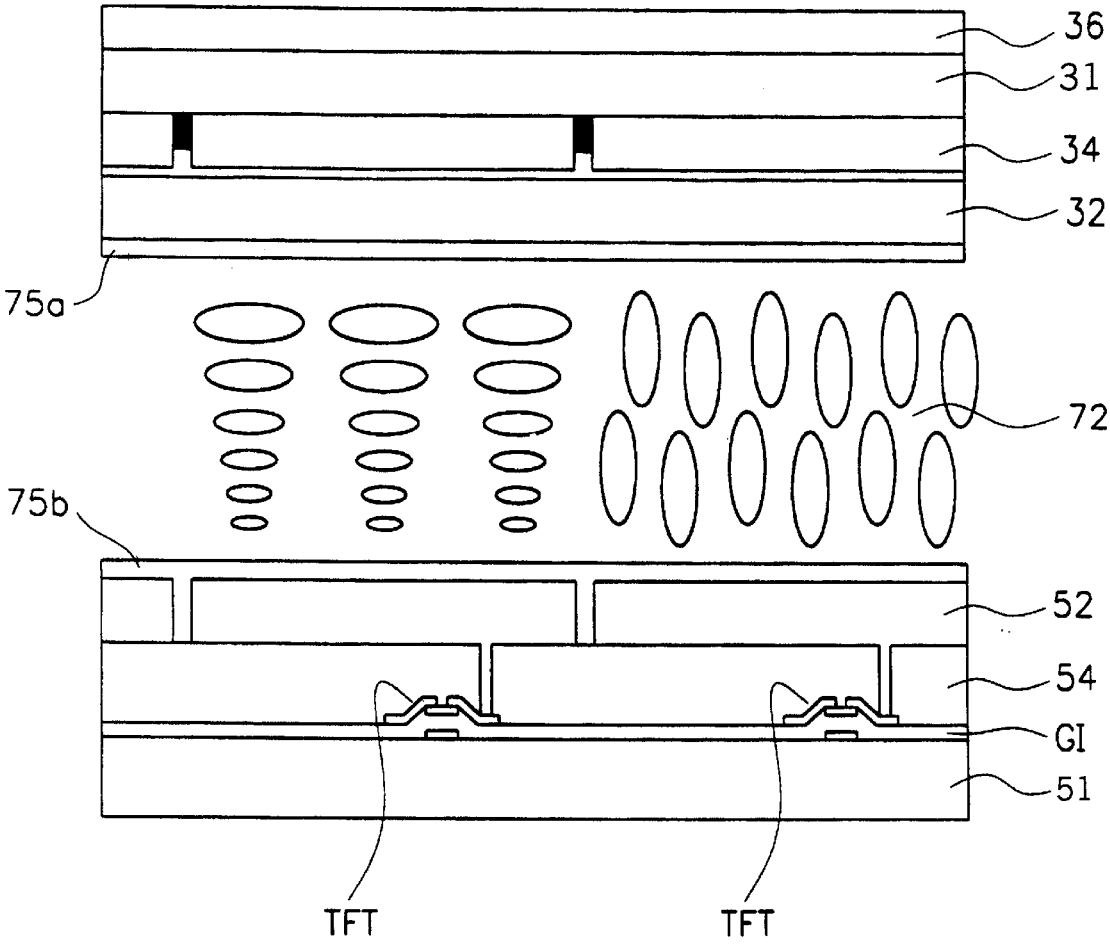
FIG. 4 illustrates a general structure of the liquid crystal display device.
Figure 5:
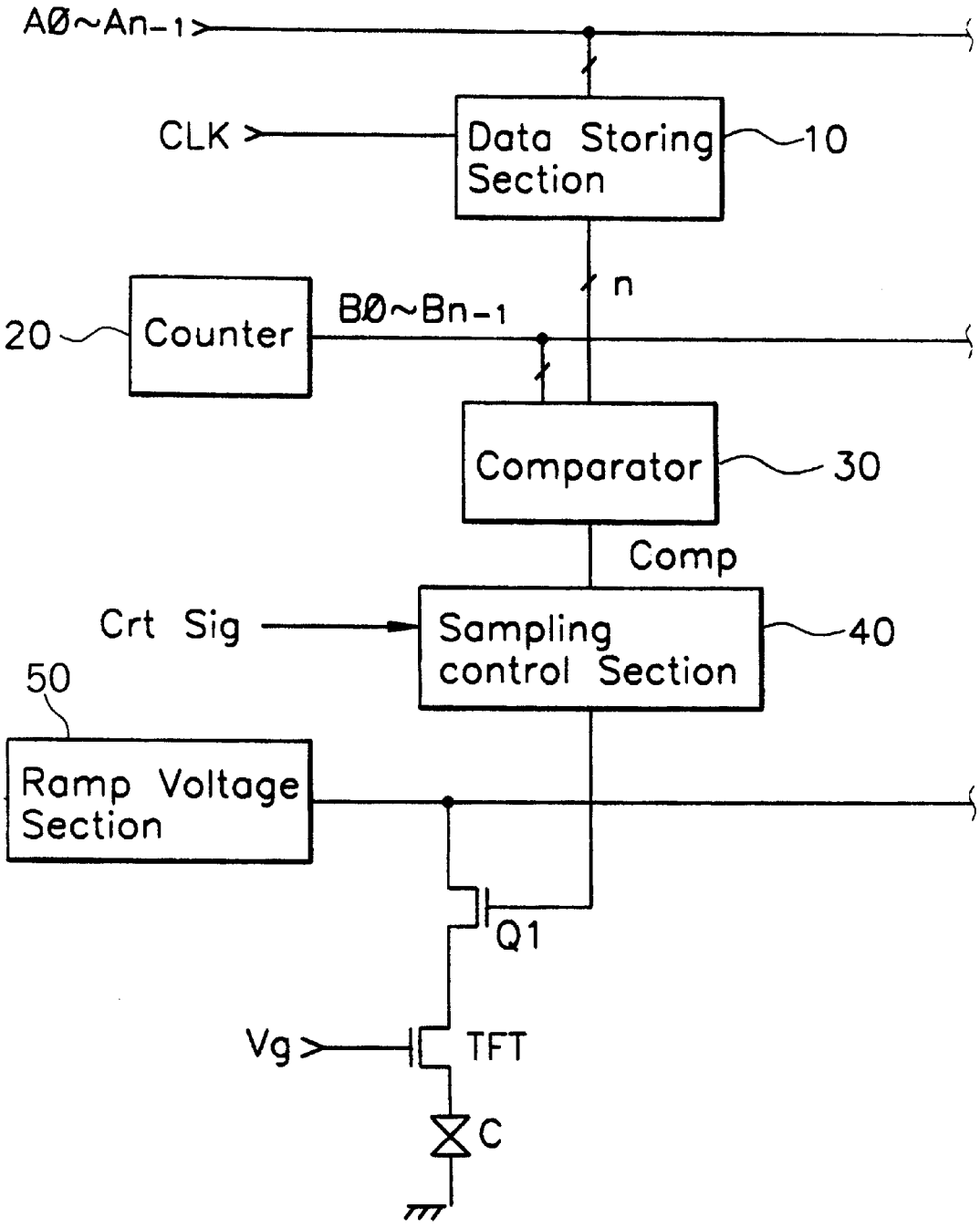
(Background Art) Fig. 5
FIG. 5 is a circuit diagram of a conventional grey-scale LCD driver for realizing multi-gradation.

FIG. 3 is a pulse waveform diagram applied to a liquid crystal capacitor according to the present invention.

The voltage level Va, to be selected as the least significant bit, should be greater than or equal to a threshold voltage to which a liquid crystal layer responds. The voltage level Vb, to be selected as the most significant bit, should be less than or equal to a saturation voltage.

A horizontal synchronization signal is activated every period of the ramp voltage, output of the counter is generated between the voltage Va and the voltage Vb.

If output of the comparator(a) is selected at the least significant bit, the sampling control section 40 controls the transistor Q1 to sample the voltage Va. And if the output of the comparator(b) is selected at the most significant bit, the sampling control section 40 controls the transistor Q1 to sample the voltage Vb. As a result, it is possible that the magnitude of the voltage applied to the liquid crystal capacitor C is adjusted.

Subsequently, when the switching element Q1 is turned off, the magnitude of the ramp voltage is decreased. The discharging switch Q2 is turned on such that the waveform of the ramp voltage is completely decreased and discharges the charges accumulated in the liquid crystal capacitor C.

When a thin film transistor used as the discharging switch Q2 is turned on by a discharging control signal DCRG, the charges accumulated in the liquid crystal capacitor C instantaneously flow to a ground terminal, ending a sampling period.

A reset signal which is generated by turning on the discharging switch may be applied several times during one frame. It is determined depending on the discharging control signal DCRG.

If the reset signal is generated once every several periods, when the ramp voltage is sampled at the output (a) or (b) of the comparator, the voltage applied to the liquid crystal layer is not decreased to a low level and maintains a raised voltage during the one frame as shown in FIG. 3.

Now, the operation of the grey-scale LCD driver according to the present invention will be explained.

In case that the number of grey scale is 256, the digital data $A_0$~$A_{n-1}$ are 8 bits of binary data. For example, if the digital data $A_0$~$A_{n-1}$ are '0001 1111', the 31th bit timing is selected. Namely, the comparator 30 receives the data '0001 1111' from the data storing section 10 and compares them with the counting data $B_0$~$B_{n-1}$ . The counter 20 begins counting a binary data and maintains counting until the 31th data '0001 1111' are counted. If the counter 20 count the 31th data '0001 1111', the comparator 30 outputs a logic level "High".

And then, the sampling control section 40 receives the logic level "High" and turns on the switching element Q1 according to the control signal of the controller Crt Sig. Therefore, the rectangular-waveform voltage outputted from the rectangular-waveform voltage generating section 150 is applied to a thin film transistor TFT through a resistor R. And then, the thin film transistor TFT activated by a scan signal Vg applies the rectangular-waveform voltage to the liquid crystal capacitor C. Therefore, the liquid crystal capacitor C is charged.

Subsequently, when the sampling operation is terminated, since the sampling control section outputs a logic level "Low", the switching element Q1 is turned off to stop charging the liquid crystal capacitor C. The liquid crystal capacitor C maintains a sampled voltage until the discharging switch Q2 is turn on. Therefore, a selected grey scale is displayed.

By this, the voltage sampled at selected bit timing is used to realize the 31th gradation.

As mentioned above, the grey-scale LCD driver according to the present invention can realize grey level image by using a rectangular-waveform voltage.

According a grey-scale LCD driver of the present invention as described above, since the voltage which is sampled at the least significant bit is hardly affected by a noise, the number of bits for representing grey-scale can be increased, and the multi-gradation of the LCD device can be realized.

Since a rectangular-waveform voltage generating circuit is a simple circuit in comparison with ramp voltage generating circuit, the area of the grey-scale LCD driver occupied on an LCD panel can be reduced, and the size of the LCD device can be reduced. Accordingly, the production cost can be reduced and the productivity can be improved.

Further, since it is easy that the output, that is, the power of the rectangular-waveform voltage is increased, the grey-scale LCD driver according to the present invention is insensitive to the load changes.

Accordingly, since the present invention can be applied to the LCD device having the different resolution, the grey-scale LCD driver according to the present invention is advantageous than the conventional grey-scale LCD driver in compatibility.

As will be evident to those skilled in the art, various modification of this invention can be made or followed in light of the foregoing disclosure without departing from the spirit of the disclosure or from the scope of the claims.

What is claimed is:

1. A grey-scale LCD driver comprising:

a data storing section for storing n bits of digital data assigned for producing a grey scale;

a counter for generating counting data;

a comparator for comparing the digital data stored in the data storing section with the counting data outputted from the counter and outputting a comparing signal if the digital data is equal to the counting data to control a sampling switching means;

a rectangular-waveform voltage generating means for generating a rectangular-waveform voltage signal applied to the sampling switching means as a driving voltage;

an integrating circuit for shaping a rectangular-waveform voltage supplied through the switching means into a ramp voltage, the integrating circuit being composed of a liquid crystal capacitor and a resistor; and a discharging switch means for discharging charges accumulated in the liquid crystal capacitor according to a control signal of a controller.

2. The grey-scale LCD driver according to claim 1 wherein the driving voltage is applied to a thin film transistor.

3. The grey-scale LCD driver according to claim 2 wherein the resistor is between the thin film transistor and the liquid crystal capacitor.

4. The grey-scale LCD driver according to claim 2 wherein the resistor is between the thin film transistor and the sampling switching means.

5. The grey-scale LCD driver according to claim 1 wherein the discharging switch means comprises a thin film transistor.

6. The grey-scale LCD driver according to claim 5 wherein the discharging switch means is between the resistor and the liquid crystal capacitor.

7. A grey-scale LCD driver comprising:

a data storing section storing n bits of digital data in sync with a clock signal, said digital data assigned for producing a grey scale;

a counter generating counting data in sync with said clock signal;

a comparator comparing the digital data stored in the data storing section with the counting data generated by the counter, said comparator generating a comparing signal when a comparison result indicates that the digital data is equal to the counting data;

a sampling control section generating a bit timing control signal in response to said comparing signal;

a rectangular-waveform voltage generating means generating a rectangular-waveform voltage signal as a driving voltage;

a first transistor being turned on by said bit timing control signal, said first transistor sampling and passing said driving voltage when turned on;

an integrating circuit shaping said driving voltage passed by said first transistor into a ramp voltage, the integrating circuit being composed of a resistor and a liquid crystal capacitor coupled in series between said first transistor and a ground terminal; and a second transistor coupled between said ground terminal and a node connecting said resistor to said liquid crystal capacitor, said second transistor discharging charges accumulated in the liquid crystal capacitor in response to a discharge control signal.

8. The grey-scale LCD driver as set forth in claim 7, further comprising a third transistor coupled between said node and said liquid crystal capacitor, wherein said first, second and third transistors are field effect transistors and said third transistor is a thin film transistor.

9. The grey-scale LCD driver as set forth in claim 7, further comprising a third transistor coupled between said first transistor and said resistor, wherein said first, second and third transistors are field effect transistors and said third transistor is a thin film transistor.

10. The grey-scale LCD driver as set forth in claim 9, wherein said third transistor is driven in response to a scan signal.

11. The grey-scale LCD driver as set forth in claim 7, wherein said second transistor is a thin film transistor.

12. The grey-scale LCD driver as set forth in claim 7, wherein said discharge control signal is generated in sync with when said ramp voltage reaches its minimum voltage level.

* * * * *